United States Patent [19]

Luening et al.

[11] Patent Number: 4,558,849

[45] Date of Patent: Dec. 17, 1985

[54] SUPPORT FOR THE DRIVE COMPONENTS OF A FRONT WHEEL DRIVE VEHICLE

[75] Inventors: Alan R. Luening, St. Francis; Robert A. Borkowski, Brookfield, both of Wis.

[73] Assignee: Applied Power Inc., Brookfield, Wis.

[21] Appl. No.: 575,697

[22] Filed: Jan. 31, 1984

[51] Int. Cl.[4] ..... B66F 3/00

[52] U.S. Cl. ..... 254/134; 254/DIG. 16

[58] Field of Search ..... 254/133 R, 134, DIG. 16, 254/89 R, 89 H; 269/296, 17

[56] References Cited

U.S. PATENT DOCUMENTS

| | | | |
|---|---|---|---|
| 2,543,264 | 2/1951 | Abbey | 254/133 |
| 2,546,909 | 3/1951 | Slaymaker | 254/133 |
| 2,747,837 | 5/1956 | Turner | 254/133 |
| 2,838,278 | 6/1958 | Johnsen | 254/134 |
| 3,040,908 | 6/1962 | Johnson | 214/1 |
| 3,095,182 | 6/1963 | Platt | 254/134 |
| 3,109,626 | 11/1963 | Arnes et al. | 254/134 |
| 3,289,868 | 12/1966 | Miller et al. | 254/89 H X |
| 3,773,293 | 11/1973 | Arnes | 254/DIG. 16 X |
| 4,269,394 | 5/1981 | Gray | 254/133 |

FOREIGN PATENT DOCUMENTS

| | | | |
|---|---|---|---|
| 2511877 | 9/1975 | Fed. Rep. of Germany | 254/133 R |
| 770770 | 3/1957 | United Kingdom | 269/296 |

OTHER PUBLICATIONS

Blackhawk Catalog Sheet.
Walker Catalog Sheet.
Owatonna Tool Co. Catalog Sheet.
Hein Werner Catalog Sheet.
Astro Tool & Equipment.
Benwil Catalog Sheet.

*Primary Examiner*—Frederick R. Schmidt
*Assistant Examiner*—Steven P. Schad
*Attorney, Agent, or Firm*—Fred Wiviott

[57] ABSTRACT

A support for the drive components of a front wheel drive vehicle includes a frame adapted to be mounted on a jack, a pair of saddle beams mounted on the frame and being adjustable vertically and horizontally relative thereto for supporting the vehicle engine and transmission. An arm is pivotally mounted at each end of the frame and includes a vertically extending portion which is adapted to be secured to the front wheel hubs for holding the transaxles and wheel struts in position as the engine, transmission, drive axles and struts are removed simultaneously from the vehicle.

8 Claims, 4 Drawing Figures

SUPPORT FOR THE DRIVE COMPONENTS OF A FRONT WHEEL DRIVE VEHICLE

BACKGROUND OF THE INVENTION

This invention relates to supports and more particularly to a support for the drive components of a front wheel drive vehicle.

In front wheel drive motor vehicles, it is advantageous to install or remove the engine, transaxle drive shafts, lower control arms, McPherson struts, wheel hubs and transmission as a unitary assembly. This operation normally requires more than one individual because it was necessary to prevent the drive shafts from pulling out of the universal mount within the transaxle housing. If this were to occur, substantial difficulties are encountered in reassembly. In addition, when the vehicle is being reassembled, it is necessary for the McPherson struts to be held in an upright position so that they can be coupled to the vehicle body.

SUMMARY OF THE INVENTION

It is an object of the invention to provide a new and improved support for the drive components of a front wheel drive vehicle.

Another object of the invention is to provide a support for the drive components of a front wheel drive vehicle which can be operated by a single individual.

A further object of the invention is to provide a support for the drive components of a front wheel drive vehicle which secures the wheel hubs, axels and struts in their normal operating positions during dissassembly, transport and reassembly.

These and other objects of the present invention will become more apparent from the detailed description thereof taken with the accompanying drawings.

In general terms, the invention comprises a support for the drive components of a front wheel drive vehicle which includes a frame adapted to be connected to the upper end of a lifting device, spaced apart support means mounted on the frame for supportingly engaging spaced apart portions of the drive components, and a pair of arm means pivotally mounted on spaced apart portions of the frame and including means for releasably securing to the frame the wheel shafts coupled to the drive components. According to more specific aspects of the invention, the supports are horizontally and vertically adjustable on the frame and each of the arm means includes bracket means extending therefrom and adapted to be releasably secured to the respective wheel hubs.

DETAILED DESCRIPTION OF THE PREFERRED EMBODIMENT

Figure 1:
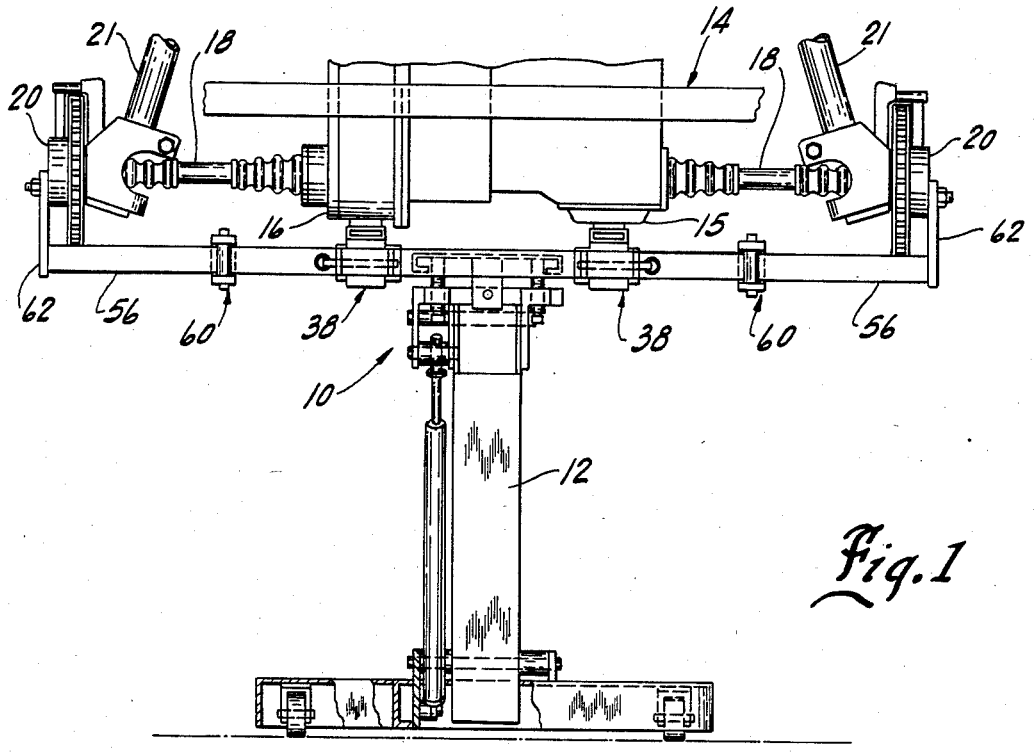
FIG. 1 is a front view showing the support according to the invention in its operative position.
Figure 4:
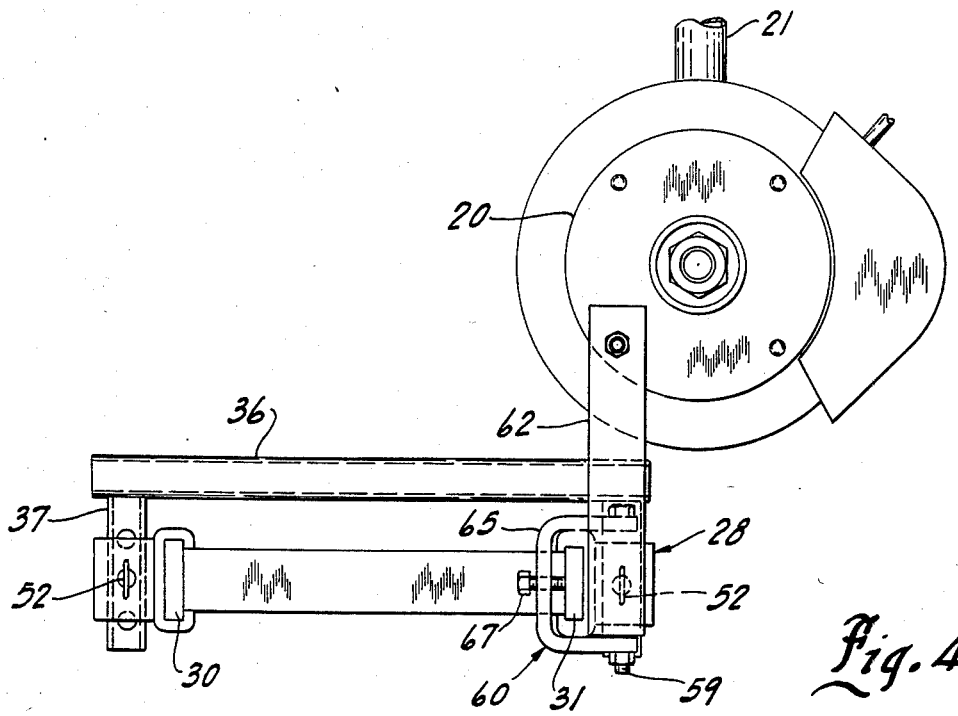
FIG. 4 is an end view of the support shown in FIG. 1.

FIG. 1 shows the support 10 according to the preferred embodiment of the invention to be mounted atop a conventional lifting device, such as jack 12. Shown to be supported atop the support 10 is the drive components of a front wheel drive vehicle. These include the engine 15, the transmission 16, the wheel axels 18, the wheel hubs 20 and the wheel struts 21.

Figure 2:
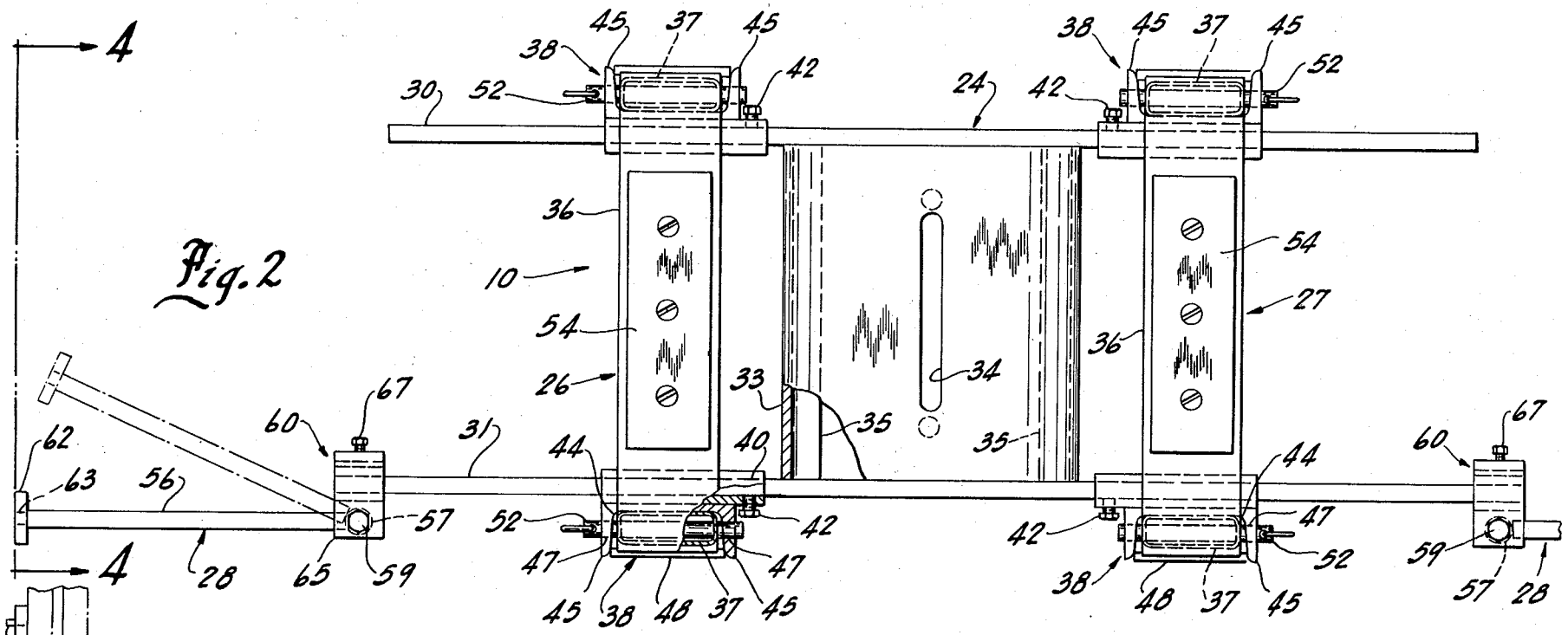
FIG. 2 is a top view of the support shown in FIG. 1.
Figure 3:
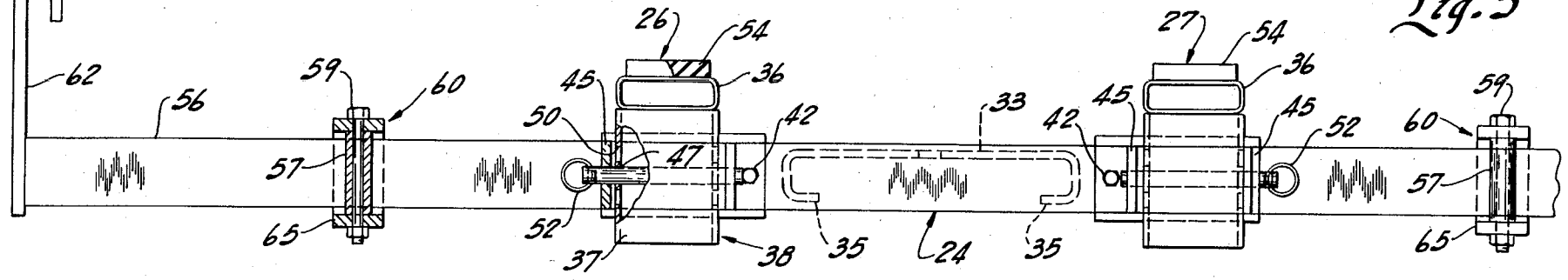
FIG. 3 is a side view of the support shown in FIG. 1.

FIG. 2 shows the support 10 which includes a main frame 24, a pair of saddle beams 26 and 27 mounted on the main frame 24 for limited longitudinal and vertical adjustment. In addition, a clamp arm 28 is pivotally mounted adjacent each end of the frame and may also be adjusted longitudinally to a limited extent. As will be discussed more fully below, spaced apart portions of the drive assembly such as the engine 15 and the transmission 16 are respectively supported by the saddle beams 26 and 27 while the clamp arms 28 are adapted to be connected to the front wheel hubs, respectively.

The main frame 24 comprises a pair of rails 30 and 31 which are held in a parallel spaced apart relation by a central web portion 33. The rails 30 and 31 comprise elongate bar members which are suitably securred to the opposite ends of the web portion 33 which comprises a relatively planar member having a depending skirt 35 at each side. Formed in a center of the web 33 and extending laterally is a slot 34 to facilitate securing the support 10 to the jack 12.

Each of the saddle beams 26 and 27 is formed of boxbeam sections and includes a central section 36 and a pair of depending end sections 37 secured to and extending downwardly from the opposite ends of the central section 36. The length of the central section 36 exceeds the width of the frame 24 so that the end sections 37 extend downwardly adjacent the outer surfaces of the rails 30 and 31. A clamp 38 is provided at each end of the saddle beams 26 and 27 for adjustably securing the downwardly extending legs 37 to the rails 30 and 31. Each clamp 38 includes a slide 40 which surrounds its respective rail 30 or 31 and is slidably mounted thereon. A clamp screw 42 is received in a threaded hole in the outer portion of each slide 40 so that each may be clamped in position on the respective rail 30 and 31. Each clamp 38 also includes a channel member 44 fixed to the outer surface of the slides 40 and having a pair of outwardly extending flanges 45. Formed in each of the flanges 45 are aligned aperatures 47. In addition, a plate 48 is fixed to the outer edges of each of the flanges 47 to define an opening for receiving the downwardly extending legs 37 of the saddle beams 26 and 27. In addition, a plurality of similarly sized openings 50 are formed in each of the opposite sides of the legs 37 with pairs of openings being in axial alignment. The legs 37 are secured to the clamps 38 by means of pins 52 which extend through the openings 47 and one pair of aligned openings 50 in the legs 37. The holes 50 also permit the saddle beams 26 to be vertically adjusted relative to the rails 30 and 31. A pad 54 of a flexible material, such as rubber, is fixed to the upper surface of each of the central members 36 of each saddle beam.

Each arm 28 includes an elongate bar member 56 having a tubular hinge member 57 attached at one end. Extending through each hinge member 57 is a hinge pin 59 which forms a part of an adjustable hinge bracket 60. At the opposite end of the bar member 56 is a vertically extending bracket member 62 having an opening 63 formed at its upper end. The hinge bracket 60 includes a generally C-shaped member 65 which extends around the rail 31. The hinge pin 59 extends downwardly through the arms of the member 65 and a clamp screw 67 extends through a threaded opening in the rear of the member 65 for engaging the rail 31. As the result, each of the arms 28 are rotatably mounted about a vertical axis and may also be adjusted longitudinally on the rail 31.

In operation of the support, the vehicle is elevated on a lift to a height approximately three feet above the floor. The jack 12 is then positioned on the center line of the vehicle with the rail 31 toward the vehicle's fire wall. The jack may then be raised and its position adjusted under the vehicle. Next, the saddle beams 26 and 27 are adjusted along the rails 30 and 31 so that they are beneath the vehicle's engine and transmission oil pans 14 and 16. If the vehicle has a subframe, the saddle beams would be positioned beneath flat portions thereof. In any event, it is desirable that the center line of the pads 54 be beneath the approximate center of gravity of the engine, transmission and axle assembly.

After the support 10 has been positioned beneath the engine and transmission, the upright brackets 62 of each of the arms 28 is elevated and placed so that its openings receive one of the wheel studs 70. When in this position, the clamp screws 42 and 67 are tightened and the wheel lug nuts are secured to the wheel studs, thus locking each wheel to one of the arms 62. During the attachment of the arms 28 to the wheel hubs, it may be necessary to raise or lower the jack to obtain proper alignment. When the arms 28 are in this position, and fixed to the wheel studs, the jack 12 is then raised until the pads 54 of the saddle beams 26 and 27 contact the engine and transaxle assembly. The engine, transmission and transaxle assembly may then be disassembled from the vehicle. Because each of the wheel hubs are secured and positioned, the axles 18 will remain in the transaxle housing and the struts 21 will remain upright after they have been disconnected from a vehicle body. If necessary, suitable straps (not shown) may be extended around the engine and transmission assemblies and hooked at their opposite ends to the rails 30 and 31 to hold the same on the frame 24 during transport.

While only a single embodiment of the invention has been illustrated and described, it is not intended to be limited thereby but only by the scope of the appended claims.

We claim:

1. A support for the drive components axles and wheel hubs of a front wheel drive vehicle;

said support including a frame adapted to be connected to a lifting device, spaced apart first and second support means mounted on the frame for supportingly engaging spaced apart portions of the drive components, third and fourth support means extending laterally from said frame, a pair of arm means pivotally mounted on horizontally spaced apart portions of the frame and including means for releasably securing the frame to the hubs and axles coupled to the drive components, first and second pivot means respectively supporting said arm means for pivotal movement, said pivot means being mounted respectively on said third and fourth support means for movement thereon toward and away from each other, each arm includes a first portion extending generally horizontally relative to said frame and being connected at one end to said pivot means for pivotal movement about a generally vertical axis and a second portion spaced from the pivot means and extending generally upwardly from said first portion, said second portions being spaced apart a distance greater than that between the wheel hubs of said vehicle when said pivot means are adjacent the remote ends of said third and fourth support means, said second portions each having an aperture adjacent the upper end thereof and spaced above said first and second support means a distance equal to that of the wheel hubs from the spaced apart portions of the drive components when said components are supported by the first and second support means, said apertures being constructed and arranged for receiving a vehicle wheel lug so that the second portion of each arm can be secured to one of the wheel hubs of the vehicle.

2. The support set forth in claim 1 wherein said frame includes first and second rail means, web means interconnecting said rail means and supporting the same in a parallel spaced apart relation, said spaced apart support means being horizontally and vertically adjustable on said rails.

3. The support set forth in claim 1 wherein said frame includes first and second rail means, web means interconnecting said rail means and supporting the same in a parallel spaced apart relation, said spaced apart support means being horizontally and vertically adjustable on said rail means.

4. The support set forth in claim 3 wherein said first and second means each includes a first part extending between said rail means and a pair of end parts extending downwardly adjacent said rail means, and clamp means for supporting each of said end parts on the adjacent rail means and for adjustably securing the same on said rail means so that said support means may be longitudinally adjusted on said rail means, said end parts and said clamp means each having mutually cooperable means for vertically adjusting said support means relative to said rail means.

5. The support set forth in claim 4 wherein said arm means are mounted on at least one of said rail means and including clamp means for adjustably securing said arm means on horizontally spaced apart portions of said rail means.

6. The support set forth in claim 5 wherein each arm means includes a first portion extending generally horizontally relative to said frame and being connected at one end thereto for pivotal movement about generally vertical axis and a second portion mounted at the opposite end of said first portion and extending generally upwardly therefrom, said second portion having an aperature adjacent the upper end thereof for receiving a vehicle wheel lug.

7. A support for the drive components of a front wheel drive vehicle;

said support including a frame adapted to be connected to a lifting device, said frame including first and second rail means, web means interconnecting said rail means and supporting the same in a parallel spaced apart relation, spaced apart support means horizontally and vertically adjustable on said rail means for supportingly engaging spaced apart portions of the drive components, said support means each includes a first part extending between said rail means and a pair of end parts extending downwardly adjacent said rail means, and clamp means for supporting each of said second parts on the adjacent rail means and for adjustably securing the same on said rail means so that said support means may be longitudinally adjusted on said rail means, said second parts and said clamp means each having mutually cooperable means for vertically adjusting said support means relative to said rail means, a pair of arm means pivotally monted on spaced apart portions of the frame, each said arm means including a first portion extending generally horizontally relative to said frame and being connected at one end thereto for a pivotal movement about a generally vertical axis, and a second portion mounted at the opposite end of said first portion and extending generally upwardly therefrom, said second portion having an aperature adjacent the upper end thereof for receiving a vehicle wheel lug for releasably securing the frame to the wheel hubs and axles coupled to the drive components, the one end of each arm also being mounted for longitudinal movement on said frame.

8. The support set forth in claim 7 wherein said arm means are mounted on at least one of said rail means and including clamp means for adjustably securing said arm means on horizontally spaced apart portions of said rail means.

* * * * *